US011004362B2

(12) United States Patent
Wang

(10) Patent No.: US 11,004,362 B2
(45) Date of Patent: May 11, 2021

(54) HANGTAG

(71) Applicant: YUAN MEI CORP., Chang Hua Hsien (TW)

(72) Inventor: King Yuan Wang, Chang Hua Hsien (TW)

(73) Assignee: YUAN MEI CORP., Chang Hua Hsien (TW)

( * ) Notice: Subject to any disclaimer, the term of this patent is extended or adjusted under 35 U.S.C. 154(b) by 0 days.

(21) Appl. No.: 16/538,530

(22) Filed: Aug. 12, 2019

(65) Prior Publication Data

US 2021/0049938 A1 Feb. 18, 2021

(51) Int. Cl.
*G09F 3/14* (2006.01)
*G09F 3/02* (2006.01)

(52) U.S. Cl.
CPC . *G09F 3/14* (2013.01); *G09F 3/02* (2013.01)

(58) Field of Classification Search
CPC ... G09F 3/14; B65D 63/109; A45F 2003/142; A45F 2005/1013
USPC ..... 40/663, 664, 665; 24/3.3, 3.4; 224/258, 224/267, 257
See application file for complete search history.

(56) References Cited

U.S. PATENT DOCUMENTS 2,669,047 A * 2/1954 Rieger ..... G09F 3/14 40/637
6,098,250 A * 8/2000 Katz ..... A41F 9/002 24/16 PB
2005/0000135 A1* 1/2005 Trigger ..... G09F 3/14 40/664
2005/0284902 A1* 12/2005 Colesanti ..... A45F 5/10 224/250
2007/0289186 A1* 12/2007 Wallace ..... G09F 3/14 40/661
2008/0250689 A1* 10/2008 Cohen ..... G09F 3/14 40/664
2010/0102098 A1* 4/2010 Stewart ..... A45F 3/14 224/258
2010/0242335 A1* 9/2010 Duval ..... F41C 27/22 42/94
2012/0090209 A1* 4/2012 Christopherson ..... G09F 3/14 40/638

OTHER PUBLICATIONS thekuvu.com Nov. 5, 2017 (Year: 2017).*

* cited by examiner

*Primary Examiner* — Gary C Hoge
(74) *Attorney, Agent, or Firm* — Muncy, Geissler, Olds & Lowe, P.C.

(57) ABSTRACT

A hangtag includes a foldable flap and a rubber ring girdling around at least one pore of the foldable flap, the rubber ring having a connecting element shaped into column, a hanging portion and a mounting portion being individually deployed on the opposite ends of the connecting element, the hanging portion and the connecting element passing through the pore and the mounting portion which leads the mounting portion to tie a knot; in such a way that the user may easily turn around the hangtag and spread out the foldable flap for reading.

4 Claims, 4 Drawing Sheets

HANGTAG

BACKGROUND OF THE INVENTION

1. Field of the Invention

This invention relates to a hangtag; in particularly to a hangtag which has rotatable and foldable advantages benefiting the user to read the foldable flap.

2. Description of the Related Art

Hangtag, as an adjunct to the merchandise specifying product information, is known to have a connecting element, such as a string or a button fixed to a flap by way of adhesive, which is devised with a simple structure for lowering producing cost. However, the connecting element is distracting when the user turn around or turn over the foldable flap for reading the information from the inner page.

SUMMARY OF THE INVENTION

The invention aims to provide the user with a hangtag which is convenient to read information.

According to above-mentioned purpose, this invention offers a hangtag having a flap and a rubber fixed on the flag, wherein the rubber ring has a connecting element shaped into column and deployed with a hanging portion and a mounting portion separate on its opposite ends. As the hanging portion and the connecting element sequentially pass through the pore and the mounting portion which leads the mounting portion to tie a knot.

Owing to its elastic property, the rubber ring may easily fit on the product, the connecting element will turn accordingly as the product rotates, and the knot tied by mounting portion hang loose or vulnerably slacken for the user to spreads out the foldable flap easier for information reading.

Besides, the aforementioned flap may be foldable and said rubber ring may fit in any pore sizes of the hangtags.

DETAILED DESCRIPTION OF PREFERRED EMBODIMENTS

Figure 1:
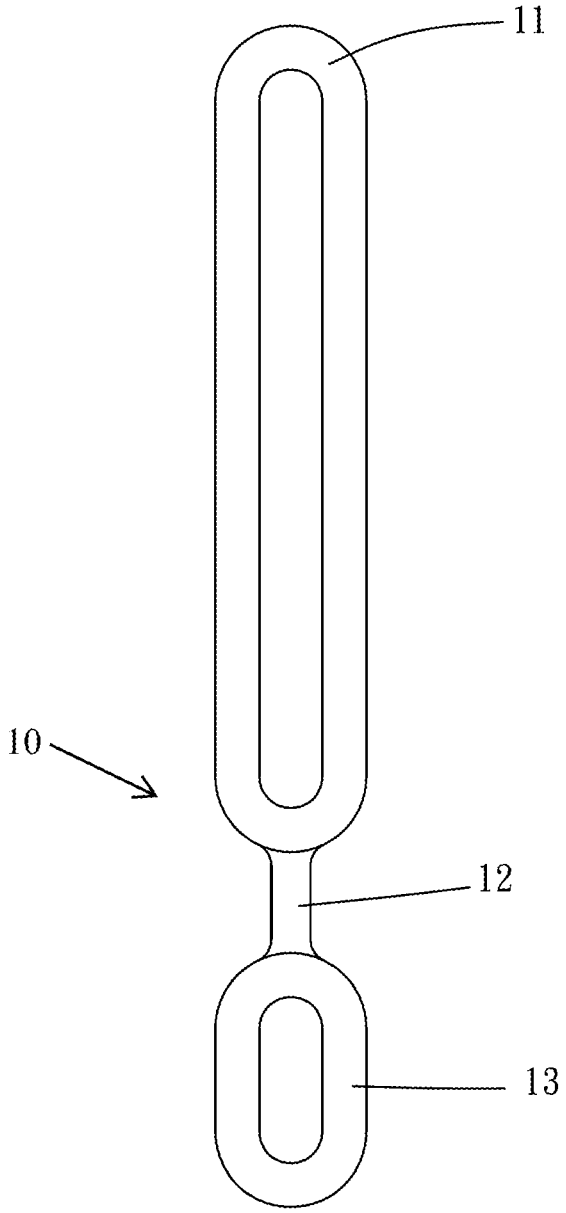
FIG. 1 is a schematic drawing illustrating the structure of the rubber ring.

FIG. 1 illustrating a rubber ring 10 for fixing a flap 20 has a connecting element 12 shaped into column, and a hanging portion 11 and a mounting portion 13 forming closed loops individually deployed on the opposite ends of the connecting element 12. In this embodiment, the rubber ring has an integral structure, composed of the mounting portion 13 and the connecting element 12 having similar sectional profiles, and can be deformed entirely when the flap 20 rotates.

Figure 2:
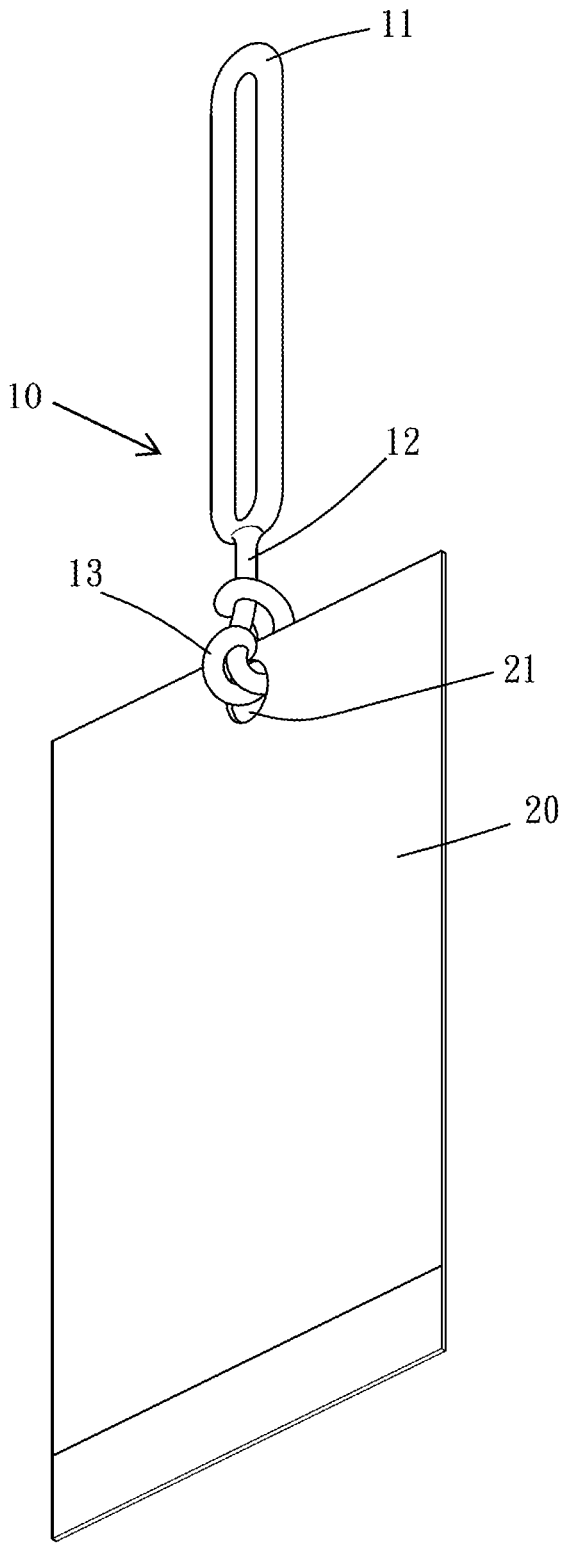
FIG. 2 is another schematic drawing illustrating the structure of the hangtag.
Figure 3:
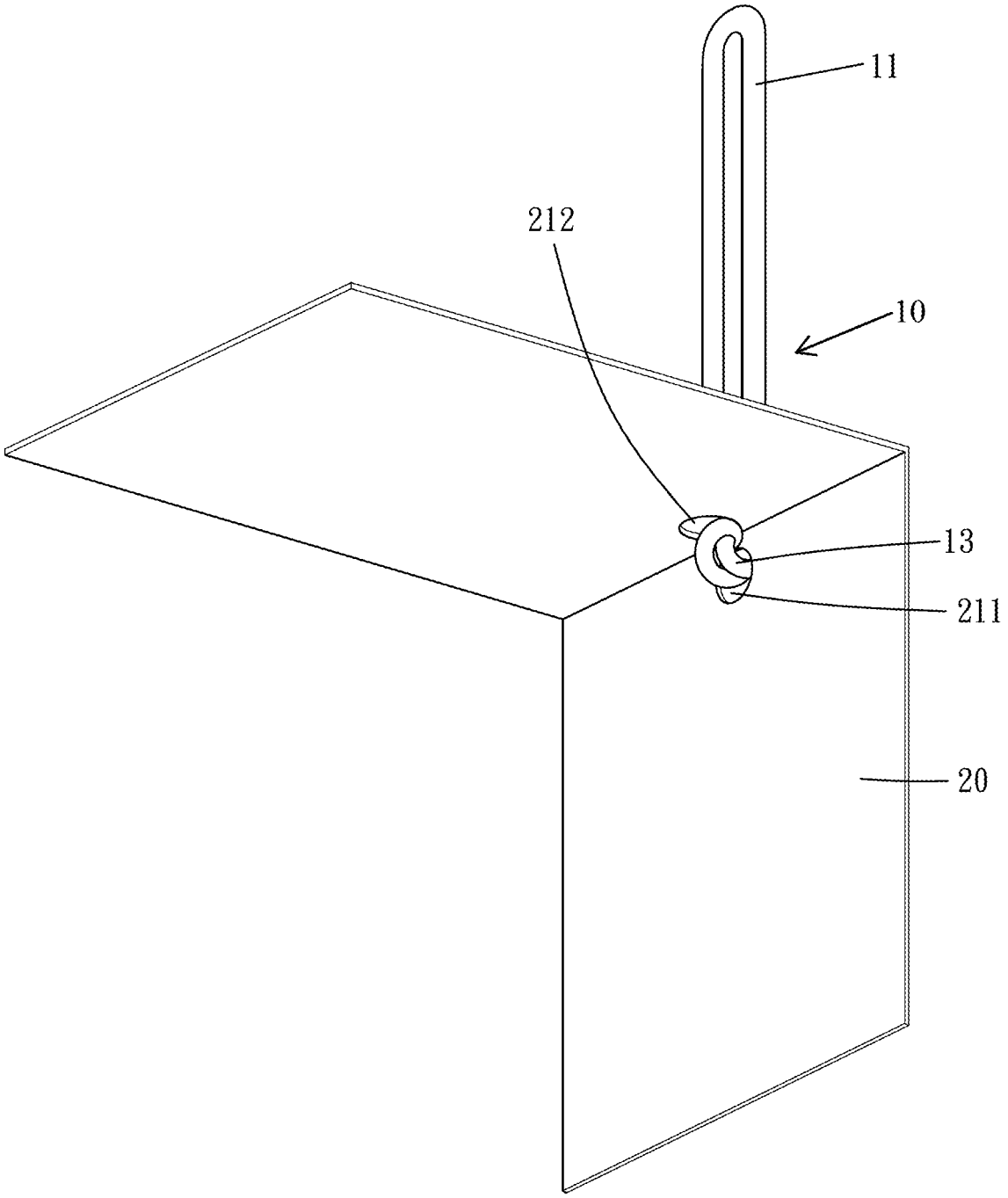
FIG. 3 is another schematic drawing illustrating the embodiment of the hangtag.
Figure 4:
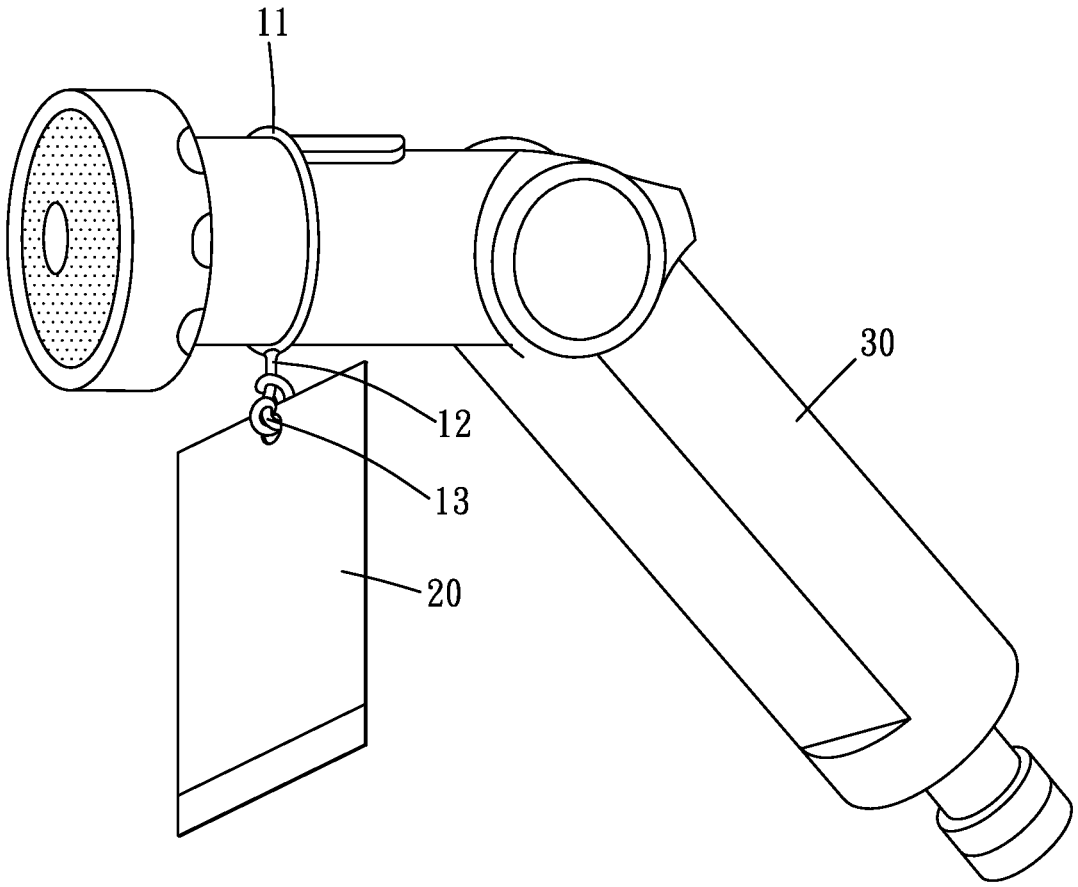
FIG. 4 is another schematic drawing illustrating the embodiment of the hangtag tagging on a product.

As the hanging portion 11 and the mounting portion 13 are separately used to mount on the product and the flap 20, the circumference of the hanging portion 11 is longer than that of the mounting portion 13. Nevertheless, the user may alter the measurements of these two portions 11 and 13 per the product's configurations. FIGS. 2 to 4 illustrating one kind of hangtags, the flap 20 is, a sheet, deployed with a pore 21. The hanging portion 11 and the connecting element 12 sequentially pass through the pore 21 and an inner circle of the mounting portion 13 which leads the mounting portion 13 to tie a knot for fixing the flap 20.

To be more specific, that the hanging portion 11 can flexibly fit on the product 30, the connecting element 12 can gently buffer between the product 30 and the flap 20 keeping the flap 20 uncovered by the product 30. Thanks to the stretchable property, the user can read the information by pulling out the flap 20. In addition, since the connecting element 12 has an elastic column configuration, it will accordingly twist as the flap 20 is rotated by the user for reading purpose. FIG. 3 illustrating a flap 20 in the embodiment has two foldable faces 23,24 arranged with pores 211 and 212 overlapping when the flap 20 close up. The hanging portion 11 and the connecting element 12 sequentially pass through the overlapping pores 211 and 212 and an inner circular of the mounting portion 13 which leads the mounting portion 13 to tie a knot. Because the inner circle is girdling around the connecting element 12, and the mounting portion 13 therefore hang loose or vulnerably slacken which benefit the foldable flap 20 to be separated out into a right angle or a plane for the user reading information from the inner page.

FIG. 1 illustrating a still status of the rubber ring in this embodiment, a mounting portion 13 has length, the longer diameter of the oval, double or triple longer than that of the connecting element. With this structural devise, the mounting portion 13 hang loose or vulnerably slacken when bent up which benefits the foldable flap to spread out. Moreover, the mounting portion 13 has width, the shorter diameter of the oval, the same as that of the hanging portion 11, and their widths are wider than that of the connecting element 12 so as to be restrained by the connecting element 12 when tied a knot.

As the rubber ring is tied up to a lesser extent, it still has sufficient resilience for the user spreading out the foldable flap 20 completely. Besides, the rubber ring in the embodiment can fit in any sizes of the pores 21 of the flap 20; therefore, the rubber ring of this invention is suitable for various kinds of hangtags. Furthermore, the rubber ring is embodied with a simple structure which is easy to set up and put into production and utilization.

What is claimed is:

1. A hangtag with a flap, comprising:

a rubber ring having a connecting element shaped into column, one hanging portion and one mounting portion, wherein the hanging portion and the mounting portion are individually deployed on opposite ends of the connecting element, the hanging portion and the connecting element are configured to pass through at least one pore of the flap and the mounting portion, which leads the mounting portion to tie a knot;

wherein the hanging portion and the mounting portion are individually formed as closed loops on opposite ends of the connecting element, wherein the hanging portion is formed as a linear closed loop without an external force, the mounting portion is two to three times a length of the connecting element so that the knot is formed by a part of the connecting element and the bended mounting portion, wherein the flap is folded to form two foldable faces, each of the foldable faces having at least one pore to lead the mounting portion to tie the knot, and wherein the hangtag is configured to spread out easily and completely with the knot tying on the folding flap.

2. The hangtag as claimed in claim 1, wherein the rubber ring has an integral structure.

3. The hangtag as claimed in claim 1, wherein a circumference of the hanging portion is longer than a circumference of the mounting portion.

4. The hangtag as claimed in claim 1, wherein the hanging portion, the mounting portion and the connecting element have similar sectional profiles.

* * * * *